United States Patent [19]

Blau

[11] 4,187,624

[45] Feb. 12, 1980

[54] SNOW PLOW

[76] Inventor: James R. Blau, 13220 W. Burlawn Ct., Brookfield, Wis. 53003

[21] Appl. No.: 884,690

[22] Filed: Mar. 8, 1978

[51] Int. Cl.[2] ..... E01H 5/04

[52] U.S. Cl. ..... 37/42 R; 37/50; 92/23

[58] Field of Search ..... 37/41, 42 R, 42 VL, 37/50, 117.5; 92/22, 23

[56] References Cited

U.S. PATENT DOCUMENTS

| | | | |
|---|---|---|---|
| 2,565,337 | 8/1951 | Allan | 37/42 R |
| 2,608,924 | 9/1952 | Bywater et al. | 37/42 R |
| 3,135,555 | 6/1964 | Caskey | 92/23 X |
| 3,165,842 | 1/1965 | Holopainen | 37/42 R |
| 3,307,275 | 3/1967 | Simi | 37/42 R |
| 3,456,369 | 7/1969 | Leposky | 37/42 R |
| 3,585,319 | 6/1971 | Payerle et al. | 37/42 R |
| 3,656,557 | 4/1972 | Eskelson et al. | 37/42 R |
| 3,706,144 | 12/1972 | Micela | 37/42 R |
| 4,026,048 | 5/1977 | Hill et al. | 37/42 R |
| 4,028,820 | 6/1977 | Simonds, Jr. | 37/41 |
| 4,039,093 | 8/1977 | Schmitz, Jr. et al. | 92/23 X |
| 4,073,345 | 2/1978 | Miller | 92/23 X |
| 4,074,448 | 2/1978 | Niemela | 37/41 |
| 4,122,758 | 10/1978 | Bieringer et al. | 92/23 |

*Primary Examiner*—E. H. Eickholt

[57] ABSTRACT

A snow plow especially suitable for use with small vehicles, such as cars, is disclosed. The snow plow features a hydraulic system for controlling movement of the plow from side to side as well as for elevating the plow. The blade elevating system of the present invention utilizes a bell crank means coupled intermediate the plow frame and a lifting bar located behind the vehicle's front bumper and provides important advantages over conventional lift systems. The snow plow of the present invention also includes a coupling system which permits the plow to be quickly coupled to the vehicle for snow plowing and quick removal of the plow when the vehicle is to be used for its conventional purposes. A system is also provided for locking the plow blade in its elevated position to keep it from falling while the vehicle is being driven from one snow removal location to another. Finally, the invention's hydraulic system is mounted in the vehicle's engine compartment where it can be locked to prevent theft.

9 Claims, 3 Drawing Figures

SNOW PLOW

FIELD OF THE INVENTION

The present invention relates generally to the art of snow plows and more particularly to snow plows of the type which are suitable for use with small vehicles, such as cars.

BACKGROUND OF THE INVENTION

Many different types of snow plows are known to the art. Conventional plows include a blade and a frame for coupling the blade to the front of a vehicle. More sophisticated plows also include means for adjusting the angular orientation of the plow blade relative to the longitudinal axis of the vehicle and for elevating the plow blade relative to the road surface to permit the vehicle to be driven from one location to another.

Prior art snow plows are also known for use with many different sizes of vehicles. For example, plows are known which can be used with very large vehicles. These plows are typically used for large snow removal jobs such as airport runway clearing and the like. Smaller plows are known which can be coupled to dump or garbage trucks for use in road clearing operations, and still smaller snow plows are know which may be coupled to yet smaller trucks for use in driveway or parking lot clearing and the like. A typical example of the latter would be the type of plow frequently employed by the owner of a gasoline station for use with his tow or pick-up truck. Following a snowfall, such a plow would be coupled to the front end of the tow truck for use in clearing the station as well as for other snow clearing jobs in the neighborhood.

The type of plow just referred to is usually quite expensive, requires considerable time to attach to a vehicle, and includes structural features which makes them impractical for use with cars. For example, such plows commonly include a hydraulic pump assembly mounted externally of the vehicle, a feature which increases the exposure of the operating components to adverse weather conditions and increases the likelihood of theft or vandalism of the equipment. Moreover, such plows also include a bulky, view-obstructing plow lifting system mounted immediately adjacent the front end of the vehicle which includes a hydraulic cylinder oriented upwardly to engage a lifting arm which in turn is coupled to the plow by a chain. Extension of the cylinder causes the arm to be elevated which in turn causes the chain to lift the plow blade above the road surface. This type of lift system, both because of its bulk and because of its tendency to shift weight off the back wheels of the vehicle, make this type of plow unsuitable for smaller vehicles such as cars. Typical examples of this type of plow are described in Simi's U.S. Pat. No. 3,037,275, issued Mar. 7, 1967, for "Vehicle Accessory Unit and Power Unit Therefore," and in Micelli's U.S. Pat. No. 3,706,144, issued Dec. 19, 1972, for "Control Means for a Snowplow." Also, the devices described in these patents make no provision for locking the blade in its elevated position. Driving a snow plow at a high rate of speed with an elevated blade is potentially dangerous, because any failure of the hydraulic system could cause the blade to fall to the road surface resulting in damage to the vehicle, or more importantly, injury to the driver. A similar result could occur if the lifting chain breaks or is accidently uncoupled from the plow.

Another related type of snow plow is described in Jackoboice's U.S. Pat. No. 3,524,269, issued Aug. 18, 1970, for "Mounting Means for Vehicular Implements." This device is different from that described above in that instead of using a vertical frame and upwardly directed hydraulic cylinder for raising the plow, it employs a horizontal cylinder which rotates a round member mounted to the plow blade frame to lift the plow. The vehicle's bumper supports one end of a lifting chain. The other end of the chain is attached to the round member and is wound therearound at the discretion of the driver to cause shortening of the chain length and resultant lifting of the blade. While the lifting mechanism is different, this type of plow still suffers from the same disadvantages as those discussed above which significantly impair the adaptability of this type of plow for use with small vehicles, such as cars.

Yet another type of lifting system for plow blades and the like is illustrated in Holopainen's U.S. Pat. No. 3,165,842, issued Jan. 19, 1965, for "Mechanism for Attaching Implements to Vehicles." In the described device a link is located intermediate the subframe assembly and the implement and a cylinder acts on the link to rotate it and push the implement upward.

None of the aforementioned systems are entirely satisfactory for use with small vehicles, such as cars. This special utility requires ease of attachment, a lift system which will not obstruct the driver's view and a blade lift system which does not cause detrimental weight distribution problems or alter the vehicle's normal driving characteristics. The development of a snow plow assembly which would obtain these objects and overcome the difficulties of the prior art would be a significant advance in this technology.

OBJECTS OF THE INVENTION

It is the primary object of the present invention to provide a snow plow assembly which can be used on a variety of sizes of vehicles, including fuel-efficient small cars.

Another object of the present invention is to provide a snow plow attachment means which includes an improved means for raising the plow blade above a surface.

Yet another object of the present invention is to provide a snow plow system in which the hydraulic means for causing movement of the plow blade is mounted within the engine compartment of a vehicle.

Still another object of the present invention is to provide a snow plow assembly which can be quickly coupled to or uncoupled from a vehicle. Another object of the present invention is to provide locking means for a snow plow, said locking means preventing a plow blade which has been elevated from falling to the road surface.

How these and other objects of the invention are accomplished will be described in the following specification, taken together with the FIGURES. Generally, however, they are accomplished by providing a vehicle subframe assembly coupled to the chassis of a vehicle, such as a car. A generally triangular plow support frame assembly is coupled to the subframe assembly by two pins. The plow frame support assembly includes a plow blade at its forward end as well as three hydraulic cylinders, two of which are for horizontally varying the angular orientation of the blade with respect to the longitudinal axis of the vehicle, and the third one of which is provided for lifting the plow blade with respect to the road surface. Each of the cylinders are coupled to a hydraulic system, the major components of which are located within the engine compartment of the vehicle. Quick connections are preferably made near the vehicle's front bumper and the controls for the cylinders are mounted in the vehicle at or near the dash board. The lifting system of the present invention includes a bell crank coupled to the free end of the piston rod of the third cylinder, to the plow frame behind the plow blade and to a support bracket mounted to a lifting bar located behind the front bumper. The bell crank itself includes two links which will be described in detail hereafter. Another feature of the preferred embodiment of the present invention is a lock sleeve which can be secured about the piston rod of the third cylinder to prevent retraction of the cylinder, even if the hydraulic system fails or any of the hydraulic hoses rupture or are punctured. Various component modifications are also described herein which are deemed to fall within the scope of the present invention.

DESCRIPTION OF THE PREFERRED EMBODIMENT

Figure 1:
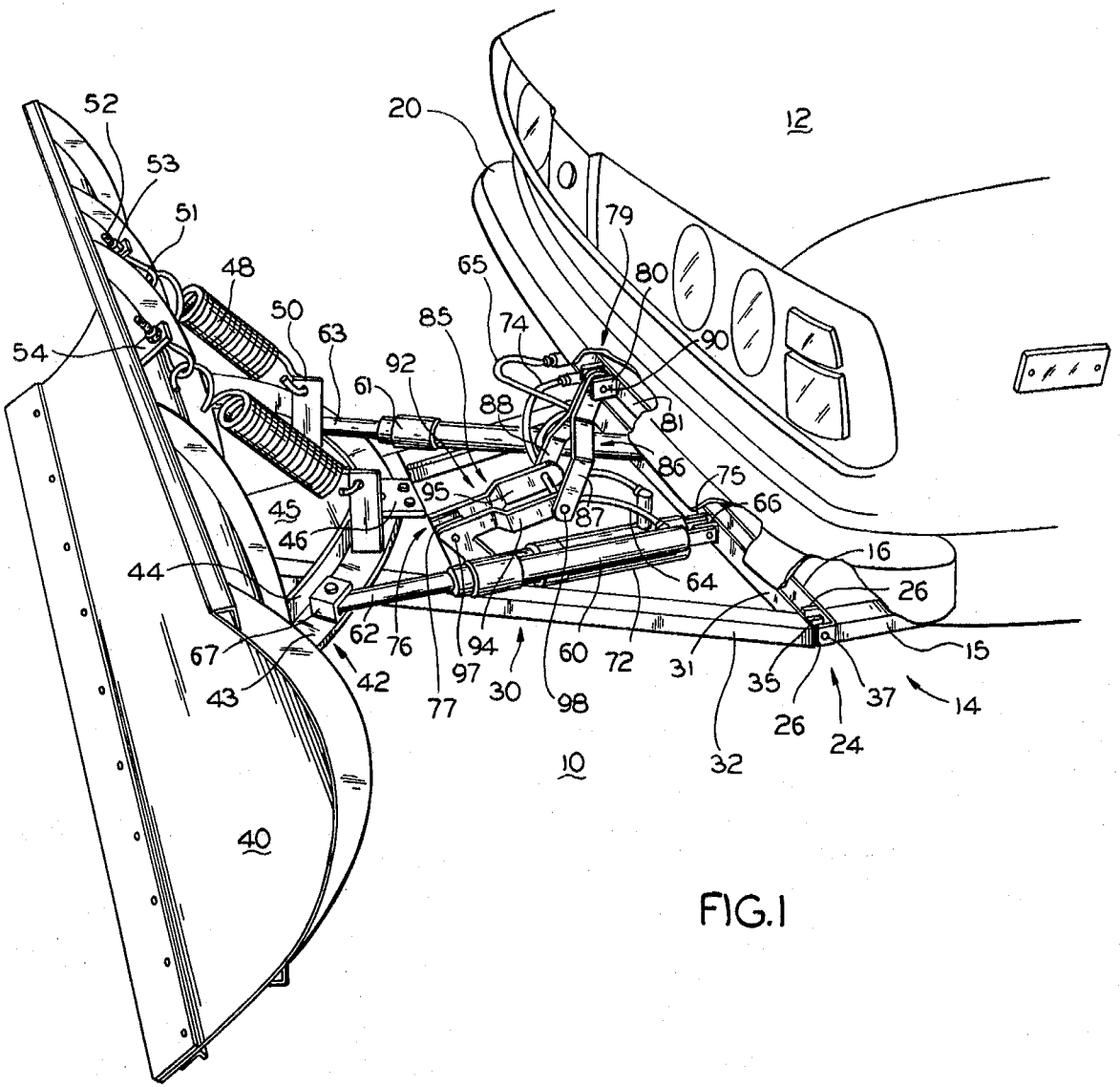
FIG. 1 is a perspective view of the snow plow assembly according to one preferred embodiment of the present invention.

FIG. 1 is a perspective view of a snow plow assembly 10 according to the preferred embodiment of the present invention. Assembly 10, as illustrated, is coupled to the front end of a car 12, but the invention is not limited for use with cars. While it is true that the snow plow of the present invention is especially useful for smaller, fuel-efficient vehicles with which other commercially available plows are not suitable, assembly 10 could be readily adapted for use with jeeps, recreational vehicles, pick-up trucks, tow trucks and other types of trucks. Moreover, the system could be used with other vehicles such as tractors, bulldozers and the like.

A coupling frame 14 is also shown in FIG. 1, frame 14 includes two side bars 15, and a front connecting member 16. Side bars 15 are parallel to one another and are preferably made of angle steel and extend from an area generally below the front bumper 20 of vehicle 12, along the bottom of the vehicle chassis just inside the wheel to an area typically near the vehicle's transmission mount (not shown). The side members 15 are bolted or otherwise securely fastened to the chassis and preferably to the front hold-down brackets, but the details thereof are not provided because the particular configuration of side bars 15 will depend on the type of car 12 with which they are to be used. It should be mentioned, however, that the system employed for mounting side bars 15 should facilitate the easy coupling and uncoupling of frame 14 to the car, since frame 14 would not normally be employed during warm weather.

The front connecting member 16 is welded between the forward ends of side bars 15 generally below the car's front bumper 20. Again, this member is preferably constructed of steel. A pair of brackets 24, which in the illustrated embodiment comprise a pair of forwardly extending short plates 26, having axially aligned holes, are provided on front member 16 just inwardly of the corners of the car 12.

The second major component of the present invention is a plow blade support frame 30 which comprises a generally triangular frame consisting of a rear side member 31 and forwardly extending side members 32. Each component is preferably constructed of angle steel. Frame 30 also includes a pair of coupling plates 35 which are welded to frame 30 adjacent the rear corners thereof, plates 35 being arranged and adapted for being inserted between the brackets 24 of frame 14. The coupling plates 35 also include a hole therethrough so that quick disconnect pins 37 may be inserted through the three aligned holes to pivotally couple blade support frame 30 to frame 14. It will be appreciated then that the forward end of frame 30 is movable about a circular arc having an axis defined by pins 37.

A conventional plow blade 40 is pivotally connected to the forward end of support frame 30 so that the horizontal orientation of the blade may be adjusted relative to the axis of the vehicle and the present invention includes means for controlling such horizontal orientation and will be discussed in a later section of this specification. Blade 40 also includes a semi-circular segment 42 welded to the back of the blade. The segment includes a flate horizontal surface 43 and a vertical ridge 44 on the inner surface of the arc forming a track-like segment. A small triangular plate 45, is welded to the front of the support 30, the bottom of segment 42 being slidably received thereon. A restraining bracket 46 is bolted to triangular plate 45 to prohibit vertical movement of segment 42 with respect to plate 45, while permitting sliding movement of horizontal surface thereunder.

FIG. 1 also shows the snow plow assembly 10 to include a pair of springs 48 which permit the blade 40 to tip relative to the road surface if an obstruction is encountered. Springs 48 are connected between a pair of vertical supports 50 welded onto either side of segment 42 and a pair of adjustable eyelets 51 secured generally near the top of blade 40 on the back side thereof. Eyelets 51 include threaded stems 52 and lock nuts to vary the length of springs 48 and in turn control the tension applied thereby. Eyelets 51 are secured to the upper portion of the blade 40 through a pair of brackets 54. From this description it should be understood that, if the bottom of plow blade 40 is obstructed during forward movement of the vehicle, the top of blade 40 will tip forwardly to allow the lower edge of the blade to pass over the obstruction.

Before proceeding with the description of the blade maneuvering system of the invention, it should be pointed out that other conventional equipment may be employed with the snow plow assembly 10. For example, adjustable skids (not shown) can be mounted to the blade support or the blade itself for displacing the blade by a preselected distance from the road surface. Likewise, any shape of plow blade may be employed, whether it be of the concave variety shown in the FIGURES or of the V-shaped design known to the art.

Referring again to FIG. 1, snow plow assembly 10 also includes a pair of hydraulic cylinders 60 and 61, for controlling the horizontal orientation of blade 40. Cylinder 60 and 61 each include an extensible piston rod 62 and 63 and hydraulic fluid hoses 64 and 65 respectively. The cylinders themselves are pivotally mounted to brackets 66 on the rear side 31 of blade support 30 and are spaced apart from one another but are relatively nearer the axis of the vehicle 12. The piston rods 62 and 63 are pivotally mounted to brackets 67 on the arcuate segment 42 intermediate the vertical supports 50 and the connections of segment 42 to the blade 40. In this manner, it can be seen that the extension of piston rod 61 and corresponding retraction of the other piston rod 62 will result in movement of the blade toward the right, and vice versa.

Figure 2:
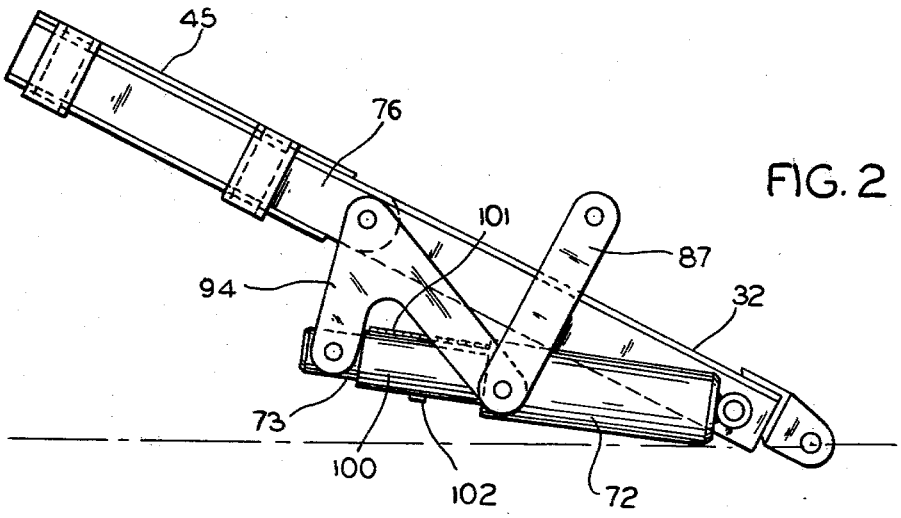
FIG. 2 is a detailed side view of the bell crank lifting system of the present invention.

By further reference to FIG. 1 and now by reference also to FIG. 2, the blade lifting mechanism of the present invention can be understood. A third hydraulic cylinder 72, having a piston rod 73, and fluid hose 74, is pivotally coupled to bracket 75 located at the middle of rear side 31 of blade support 30. In this position, piston rod 73 is oriented generally toward triangular plate 45. Another bracket 76 is mounted horizontally to the rear surface of plate 45, bracket 76 including a pair of parallel plates 77 having aligned holes (not shown). Yet another bracket 79 is provided behind the car's bumper (see the cut-away portion of FIG. 1), bracket 79 in turn being welded to an elongated steel lift bar member 81 which is rigidly secured to the front of car 12 on the vehicle's bumper bracket (not shown) or to the car's frame. Bracket 79 also includes a pair of parallel short plates 80 having aligned holes therein, but this bracket is directed generally downwardly and slightly forwardly.

A bell crank assembly 85 is mounted between brackets 76 and 79 and the end of piston rod 73 as will now be described. Assembly 85 includes a first generally Y-shaped link member 86 which includes symmetrical side plates 87 and 88. Plates 87 and 88 are welded to one another at the top of link 86 and fit between the plates 80 of bracket 79 and are pivotally secured thereto by pin 90. Side plates 87 and 88 diverge from one another below bumper 20 and then are bent so as to be parallel to one another. A hole (not shown) is provided at the lower end of each of plates 87 and 88.

A second link member 92 is also included in crank assembly 85. Link 92 also includes a pair of side members 94 and 95 each of which is generally L-shaped, the angle between the long and short portions of sides 94 and 95 actually being acute in the preferred embodiment. The long portions of sides 94 and 95 are pivotally mounted to bracket 76 (by pin 97) and to link 86 by a pin 98 passing through sides 87, 88, 94 and 95. The shorter portion of sides 94 and 95 are pivotally coupled between bracket 76 and the end of piston rod 73. It will then be apparent that extension of pistion rod 73 will result in the lower end of link 92 being pushed forwardly under pin 97 causing the entire blade 40 and support 30 to be tilted upwardly. In FIG. 2, the cylinder 72, its piston rod 73, and the link members 86 and 92 are shown in the position they occupy when the blade is elevated.

The piston rod locking means of the present invention is also shown in FIG. 2 to include a cylindrical sleeve 100 adapted to surround the extended piston rod 73. The sleeve 100 is split along its length and is hinged on one side by a hinge 101 while a latch 102 is provided on the other side. Locking sleeve 100 is used as follows: When the blade is elevated (FIG. 2) the locking sleeve is opened and folded back about hinge 101. The sleeve is then placed around the piston rod 73 and locked into place by latch 102. When the sleeve is secured in place, the piston rod cannot be retracted, even if a failure occurs in the hydraulic fluid system.

Figure 3:
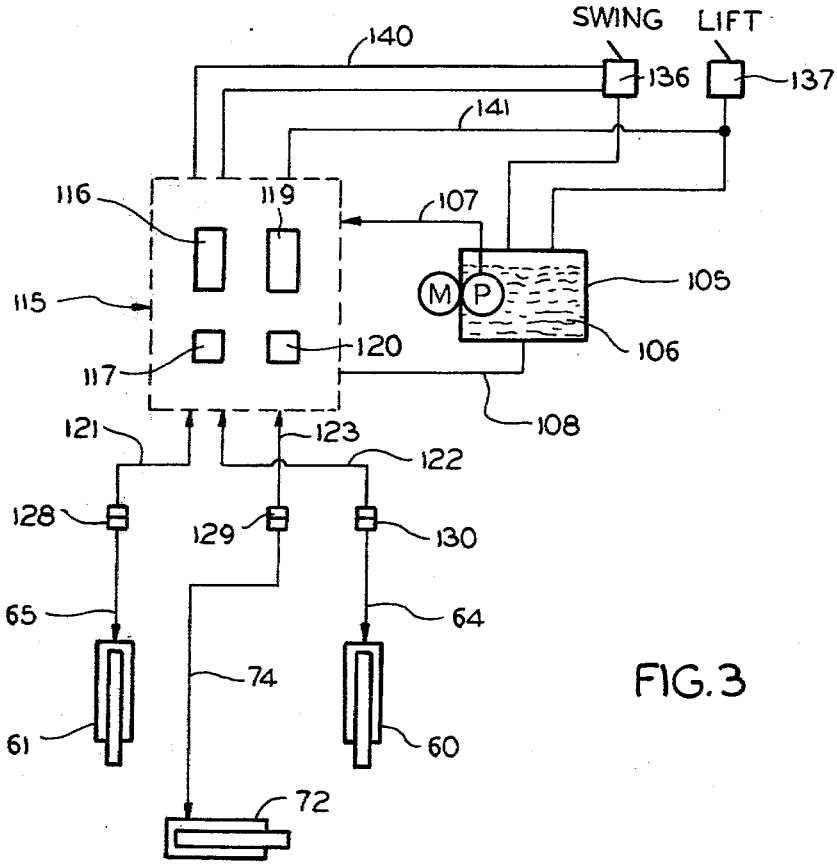
FIG. 3 is a schematic of the hydraulic system of the present invention.

FIG. 3 shows in schematic form the hydraulic and cylinder control system of the present invention. The placement of the operating components in the vehicle is not critical to the present invention, but it is preferred that the reservoir pump and valve components now to be described be mounted under the hood of the car 12 in its engine compartment.

The hydraulic system includes a tank 105 of hydraulic fluid 106 having inlet and outlet hoses 107 and 108 respectively. A pump P driven by an electric motor M powered by the car's electrical system is coupled to hoses 107 and 108 for supplying and receiving hydraulic fluid from a manifold valve assembly 115.

Valve assembly 115 in turn includes a directional control valve 116 and cross-over relief valve 117 for regulating the horizontal swing of blade 40 and a directional control valve 119 and lock valve 120 for control of the lift system. Hoses 121 and 122 leave the valve assembly swing components and are coupled respectively to hoses 64 and 65 while another fluid hose 123 from the valve lift components is coupled to hose 74. Quick disconnect couplings 128–130 are provided for allowing rapid coupling and uncoupling of the respective hoses between those mounted to the car and those mounted to plow assembly 10.

Toggle switches 136 and 137 are also included in the system, the toggle switches preferably being mounted on the dash board of the car or at some other interior location where they are readily accessible to the driver. Switch 136 is coupled to the valve swing components by wires 140 and controls the flow of fluid to and from cylinders 60 and 61, while switch 137 is connected to the valve lift components by wires 141 and controls the flow of fluid to cylinder 72.

Now that the major components of the present invention have been described, its operation will be explained. When cold weather approaches, frame 14 is bolted to the chassis of car 12. It is assumed that the hydraulic components have been mounted to the car and that switches 136 and 137 have been installed on the car's dash board. Hoses 121, 122 and 123 have their free ends located for ready access from outside the car 12.

When it is desired to use the plow assembly 10 it is connected to the car by merely inserting pins 37 in the two brackets coupling frame 14 to blade support frame 30 and by inserting an additional pin 80 in bracket 79 so that the link member 86 is secured behind bumper 20. The hydraulic hoses 64, 65 and 74 are then coupled hoses 121, 122 and 123 respectively to complete the mounting of assembly 10.

It will be apparent from the foregoing description that toggle switch 137 can be moved by the driver to control the elevation of blade 40 and that toggle switch 136 can be selectively moved to change the horizontal orientation or swing of blade 40.

While the present invention has been described in connection with a single preferred embodiment, it is not to be limited by such description but is to be limited solely by the claims which follow. For example, while the invention has been described in connection with a snow plow, the lift system of the present invention is adaptable for use with bulldozer blades, or other similar types of implements.

I claim:

1. A snow plow assembly suitable for use with a vehicle comprising:

bracket means on said vehicle for receivably accepting a plow support frame;

a plow support frame adapted for being coupled to said vehicle bracket means and including means for adjusting the angular orientation of a snow plow blade;

a plow blade coupled to the front of said frame and to said adjustment means;

bell crank means coupled between the front of said vehicle and a forward portion of said frame to permit vertical adjustment of said blade;

cylinder means including a first cylinder mounted to said frame and having a piston rod means coupled to said bell crank means for moving same to cause said vertical adjustment, and fluid means for extending and retracting said piston rod means;

first bell crank coupling bracket means mounted to said vehicle above said snow plow accepting bracket means and second bell crank coupling bracket means on said frame generally adjacent said plow blade;

said bell crank means including a first generally Y-shaped link member the base of which is coupled to said first bell crank coupling bracket means and a second generally L-shaped link member having first and second sides, the end of said first side being coupled between the free ends of said first link member and the free end of said second side being pivotally coupled to said piston rod of said first cylinder, the angular corner of said second link member being pivotally coupled to said second bell crank coupling bracket means.

2. The invention set forth in claim 1 wherein said angular adjustment means includes second and third cylinders mounted to said frame and having piston rods adapted for varying the horizontal orientation of said blade relative to said vehicle and further including fluid means for selectively extending and retracting said piston rod means of said second and third cylinders.

3. The invention set forth in claim 2 wherein said frame comprises a generally triangular frame a first side of which is pivotally coupled to said vehicle bracket means whereby the said triangular frame is vertically rotatable with respect to said first side, said blade being mounted to the corner of said frame between said second and third sides, each of said cylinders being pivotally mounted to said first side with said first cylinder being intermediate said second and third cylinders.

4. The invention set forth in claim 3 wherein said fluid means comprises a hydraulic fluid reservoir and pump means mounted within the engine compartment of said vehicle and hydraulic manifold valve means and conduit means for selectively directing fluid to said cylinders.

5. The invention set forth in claim 3 wherein said snow plow system includes a vehicle subframe assembly rigidly coupled to the underside of said vehicle and including a front member extending across and beneath the front of said vehicle, said bracket means being located on said front member and including a pair of spaced apart bracket means having axially aligned holes passing therethrough, said first side of said frame including a pair of bracket plate means adapted for being coupled to said spaced apart bracket means by pin means.

6. The invention set forth in claim 1 wherein said fluid means comprises a hydraulic fluid reservoir and pump means mounted within the engine compartment of said vehicle and hydraulic manifold valve means and conduit means for selectively directing fluid to said cylinders.

7. The invention set forth in claim 1 further including sleeve means about said piston rod means when said piston rod means is extended.

8. The invention set forth in claim 7 wherein said sleeve means includes a split, elongate cylinder having hinge means on one side and latch means on the other.

9. A system for mounting an implement to a vehicle, said system being of the type wherein said implement may be selectively elevated and lowered, said system comprising:

a frame secured to the underside of said vehicle and including bracket means for receiving an implement support;

an implement support having bracket means adapted for being coupled to said frame bracket means whereby said implement support may be pivotally mounted to said vehicle frame;

an implement mounted to said support and spaced apart from said implement bracket means;

another bracket means mounted to said vehicle above said vehicle frame;

bell crank means coupled between said another bracket means and a bell crank receiving bracket means on said support frame;

hydraulic cylinder means having extensible piston rod means coupled to said bell crank means for elevating and lowering said implement;

hydraulic fluid reservoir, pump and valve means located within said vehicle and conduit means coupling same to said cylinder;

switch means coupled to said valve and pump for controlling the extension of said piston rod means;

said bell crank means including a first generally Y-shaped link member the base of which is pivotally coupled to said vehicle bracket means and a second generally L-shaped link member having first and second sides, the end of said first side being coupled between the free ends of said first link member and the free end of said second side being pivotally coupled to said piston rod of said first cylinder, the angular corner of said second link member being pivotally coupled to said bell crank receiving bracket means.

* * * * *